US005428515A

United States Patent [19]

Jung

[11] Patent Number: 5,428,515

[45] Date of Patent: Jun. 27, 1995

[54] ELECTRIC LIGHTING ASSEMBLY

[76] Inventor: Huang H. Jung, P.O. Box 82-144, Taipei, Taiwan

[21] Appl. No.: 178,865

[22] Filed: Jan. 7, 1994

[51] Int. Cl.[6] ..... H01R 33/02

[52] U.S. Cl. ..... 362/226; 362/216; 362/363; 313/318.03; 439/651; 439/646; 439/236

[58] Field of Search ..... 362/226, 263, 216, 353, 362/363, 265; 313/318; 439/651, 645, 646, 236, 242

[56] References Cited

U.S. PATENT DOCUMENTS

| | | | |
|---|---|---|---|
| 3,815,080 | 6/1974 | Summa | 439/646 X |
| 4,593,344 | 6/1986 | Basile | 362/226 |
| 4,623,823 | 11/1986 | Engel | 313/318 X |
| 4,723,200 | 2/1988 | Troen | 439/236 |
| 4,822,302 | 4/1989 | Dorleans | 362/226 X |
| 5,044,974 | 9/1991 | Pelton et al. | 439/645 X |
| 5,189,339 | 2/1993 | Peshak | 362/216 X |
| 5,289,079 | 2/1994 | Wittmann | 362/226 X |

*Primary Examiner*—Ira S. Lazarus
*Assistant Examiner*—Thomas M. Sember
*Attorney, Agent, or Firm*—Alfred Lei

[57] ABSTRACT

An electric lighting assembly including; a protective holder formed on the top with two holes and at two opposite sides with depending lugs, said lugs having a hook portion at the lower end, a ring contact secured on the top of said protective holder, said ring contact being provided on the top with a tip contact and the outer peripheral wall with spiral threads, said tip contact and said spiral threads being electrically connected with the two holes of said protective holder, a conical member connected with the two holes of said protective holder and supported by the hook of said lugs, and a light bulb connected with said conical member, whereby the neon light can be conveniently used indoors.

1 Claim, 5 Drawing Sheets

ELECTRIC LIGHTING ASSEMBLY

BACKGROUND OF THE INVENTION

It has been found that the conventional neon light on the market is designed for use outdoors and cannot be directly connected with the commonly used electrical socket thereby limiting its usage. Further, the light bulb is threadedly engaged with the conventional electrical socket hence making it inconvenient in use.

Therefore, it is an object of the present invention to provide an electric lighting assembly which may obviate and mitigate the above-mentioned drawbacks.

SUMMARY OF THE INVENTION

This invention relates to an electric lighting assembly.

It is the primary object of the present invention to provide an electric lighting assembly which is easily connected to a light bulb.

It is another object of the present invention to provide an electric lighting assembly which can be conveniently connected with a neon light.

It is still another object of the present invention to provide an electric lighting assembly which is facile to manufacture.

It is still another object of the present invention to provide an electric lighting assembly with which a neon light can be rotatably connected.

It is a further object of the present invention to provide an electric lighting assembly which is simple in construction.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
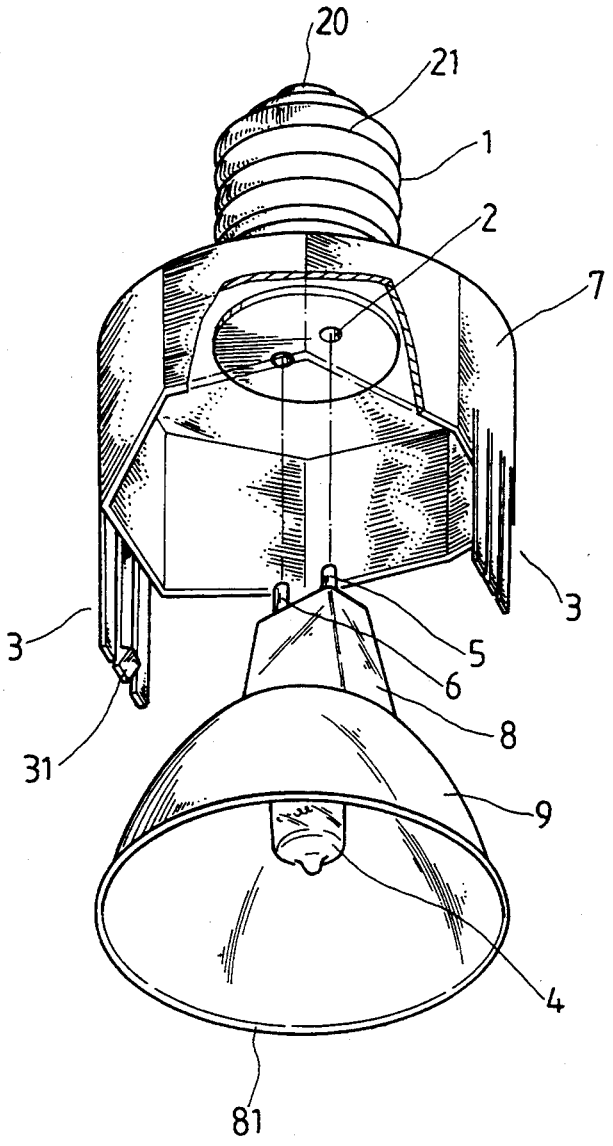
FIG. 1 is an exploded view of an electric lighting assembly according to the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the electric lighting assembly according of the present invention mainly comprises a ring contact

1 and a protective holder 7. The ring contact 1 is provided on the top with a tip contact 20 and on the outer peripheral wall with spiral threads 21 adapted to engage with an electrical socket (not shown). Further, the ring contact 1 is fixedly mounted on the upper end of the protective holder 7. The upper end of the protective holder 7 is formed with two holes 2 one of which is electrically connected with the spiral threads 21, and the other one of which with the tip contact 20 of the ring contact 1. The two holes 2 are designed to receive the two terminals 5 and 6 of a light seat 8. From two opposite sides of the protective cover 7 depend three lugs 3. The central lug 3 is formed with a hook 31. The light seat 8 has a conical shade 9 and has a receptacle (not shown) for receiving a halogen bulb 4.

When in use, simply insert the light seat 8 into the holder 7 with the terminals 5 and 6 engaged with the holes 2. As the light seat 8 is inserted into the holder 7, the lower rim 81 of the conical shade 9 is supported by the hook 31 of the central lug 3 thereby keeping the light seat 8 firmly engaged with the holder 7.

Figure 2:
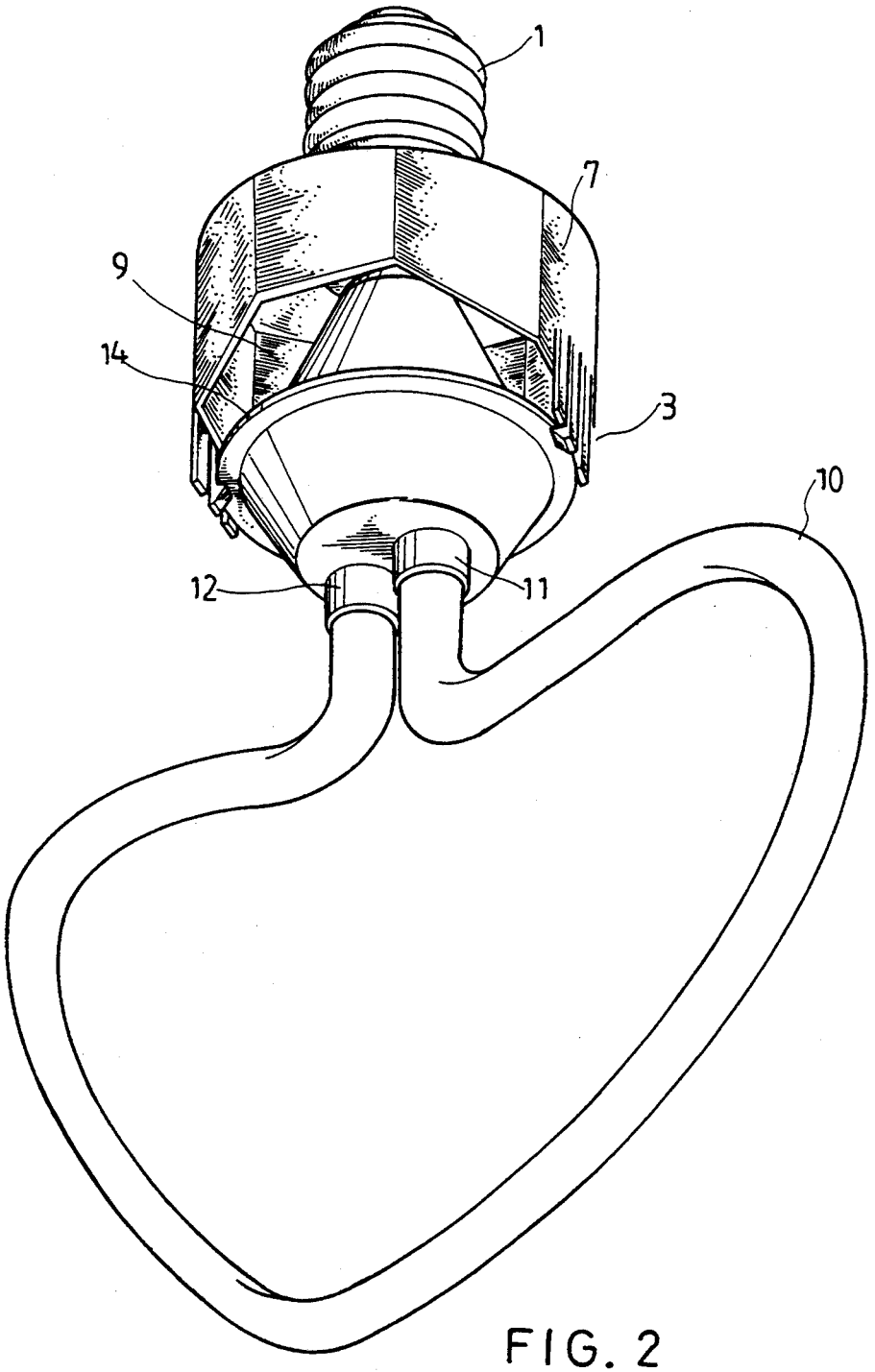
FIG. 2 shows a second preferred embodiment of the electric lighting assembly according to the present invention.

FIG. 2 shows a second preferred embodiment of the present invention. As illustrated, a neon light having the shape of a heart and an inverted conical member 14 on the top may be connected with the conical shade 9 as desired. The ballast (not shown) connected with the electrodes 11 and 12 of the neon light 10 may be of any conventional design well known to those skilled in the art and is not considered as part of the invention.

Figure 3:
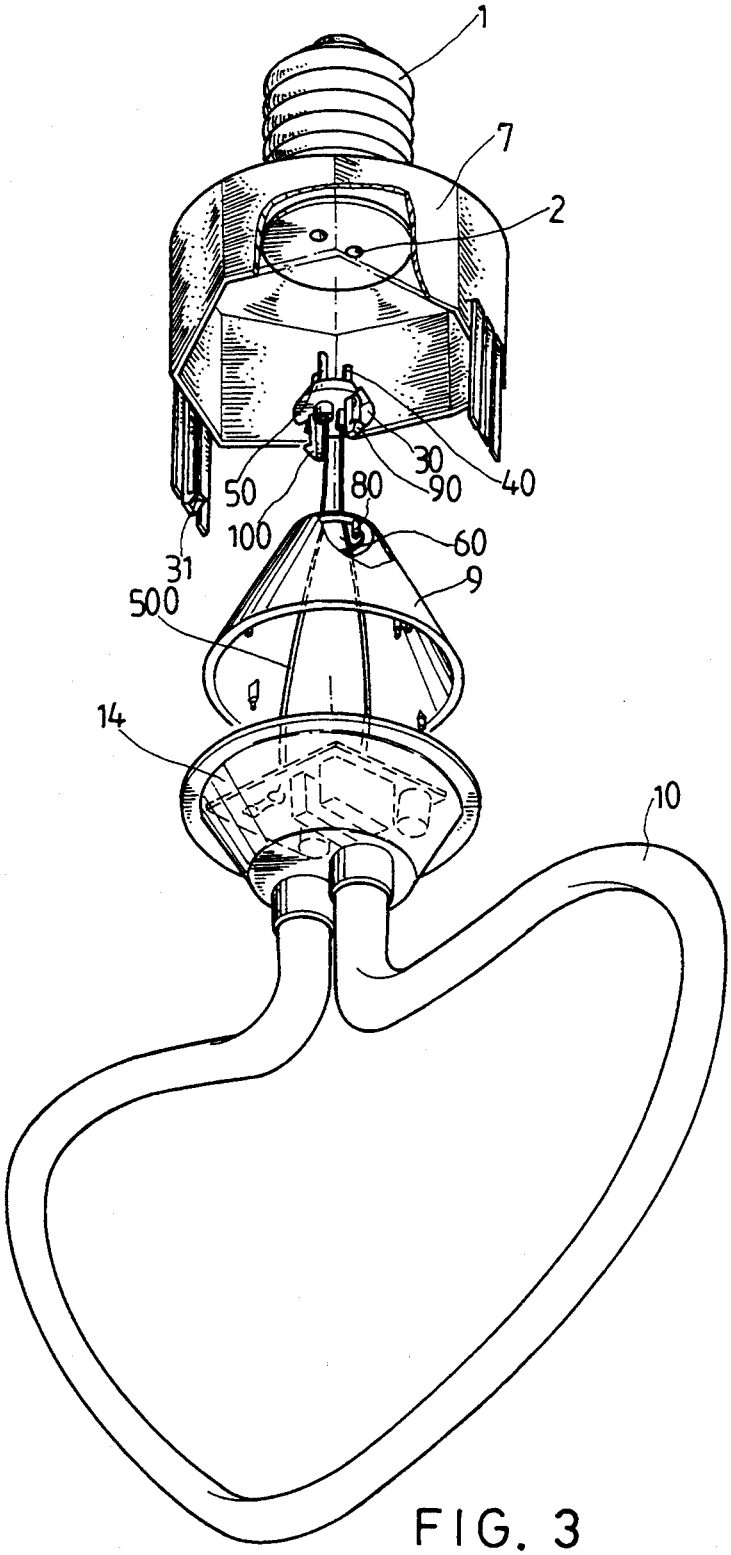
FIG. 3 is an exploded view of a third preferred embodiment of the electric lighting assembly according to the present invention.

FIG. 3 shows a third preferred embodiment of the present invention. As may be seen, a suspending seat 30 having two conducting pins 40 and 50 on the top and two opposite hook portions 90 and 100 on the bottom is connected with the protective holder 7 with the pins 40 and 50 engaged with the holes 2. The conical member 9 is formed on the top with an opening 60 provided with a stop member 80. In assembly, simply press the hook portions 90 and 100 of the suspending seat 30 into the opening 60 of the conical member 9 thereby enabling the conical member 9 to rotate with respect to the suspending seat 30. As the conical member 9 is rotated about the suspending seat 30, one of the hook portions 90 and 100 of the suspending seat 30 will be in contact with the stop member 80 of the conical member 9 thus limiting the conical member 9 to be able to rotate through an angle of 180 degrees and therefore preventing the connecting electrical wires 500 from being tangled together. Hence, the neon light 10 connected with the conical member 9 can be rotated within an angular range of 180 degrees as desired.

Figure 4:
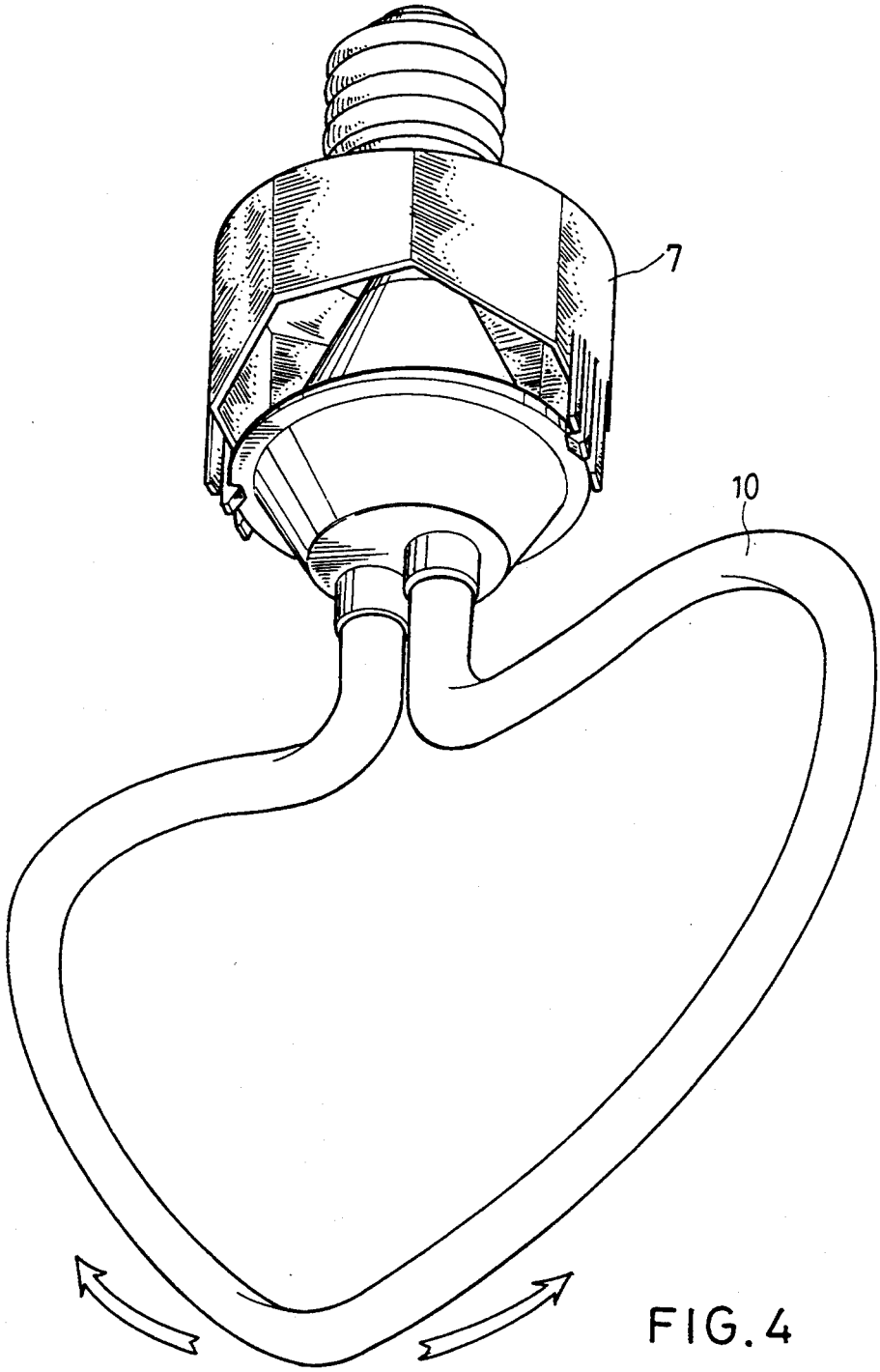
FIG. 4 shows a working view of the third preferred embodiment of the electric lighting assembly.

FIG. 4 shows a working view of the third preferred embodiment of the present invention.

Figure 5:
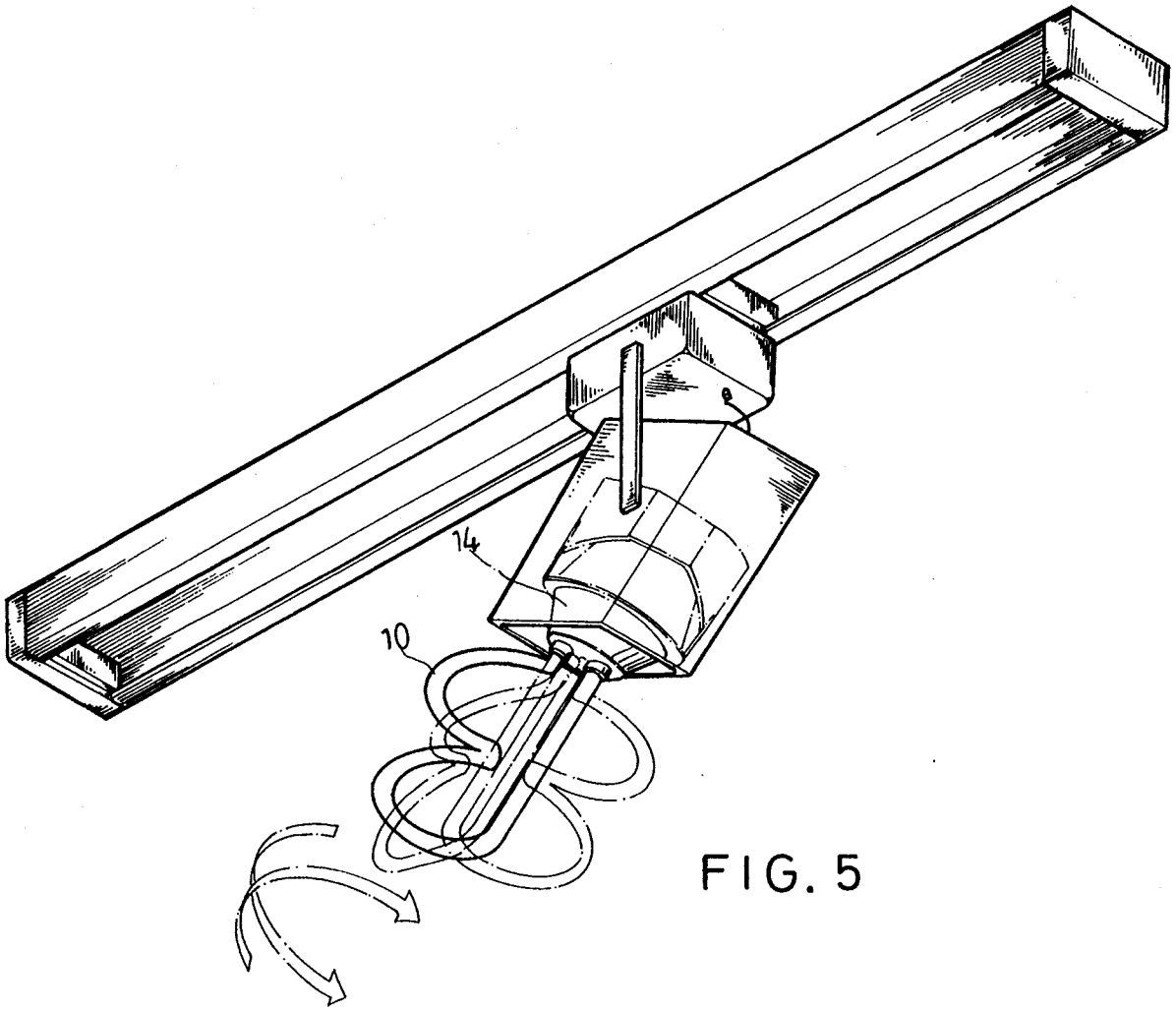
FIG. 5 shows another application of the third preferred embodiment of the electric lighting assembly.

FIG. 5 shows another application of the third preferred embodiment.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An electric lighting assembly comprising:

a protective holder having two holes at an upper end, said holder having two opposite sides with extending lugs, each lug having a first hook portion at a lower end of said holder;

a ring contact secured on the upper end of said protective holder, said ring contact having a tip contact and an outer peripheral wall with spiral threads, said tip contact and spiral threads being electrically connected with the two holes of said protective holder;

a suspending seat provided with two pins insertable with the two holes of said protective holder, said suspending seat having two second hook portions at a lower end of suspending seat;

a conical member formed with an opening having a stop member, the opening of said stop member being engaged with the second hook portions of said suspending seat so that when said conical member is rotated with respect to said suspending seat, one of the second hook portions of said suspending seat will be in contact with the stop member thereby limiting the conical member to be able to rotate through an angle of 180 degrees only; and a neon light provided with an inverted conical member engaged with said conical member and supported by the first hook portions of the lugs of said protective holder.

* * * * *